United States Patent [19]

Balakrishnan et al.

[11] Patent Number: 5,009,748

[45] Date of Patent: Apr. 23, 1991

[54] PROCESS AND SYSTEM FOR CONTROLLING THE BASIS WEIGHT OF A SHEET MATERIAL

[75] Inventors: Ramesh Balakrishnan, Stanford; Mathew G. Boissevain, Los Altos, both of Calif.

[73] Assignee: Measurex Corporation, Cupertino, Calif.

[21] Appl. No.: 197,752

[22] Filed: May 23, 1988

[51] Int. Cl.[5] ..... D21F 11/00

[52] U.S. Cl. ..... 162/198; 162/199; 162/212; 162/262; 162/263; 162/344; 162/347; 162/DIG. 6; 162/DIG. 10; 73/862.04; 73/862.65

[58] Field of Search ..... 162/DIG. 6, DIG. 10, 162/199, 198, 212, 347, 344, 262, 263; 73/862.04, 862.65; 338/5; 364/508, 568

[56] References Cited

U.S. PATENT DOCUMENTS

| | | | |
|---|---|---|---|
| 2,995,034 | 8/1961 | Boiten | 338/5 |
| 3,358,257 | 12/1967 | Painter et al. | 338/5 |
| 3,439,761 | 4/1969 | Laimins | 177/211 |
| 3,448,424 | 6/1969 | Laimins | 338/5 |
| 3,767,900 | 10/1973 | Chao et al. | 126/DIG. 6 X |
| 4,285,234 | 8/1981 | Basily et al. | 73/862.65 |
| 4,482,783 | 11/1981 | Laimins | 177/147 |
| 4,505,779 | 3/1985 | Boissevain | 162/199 |
| 4,517,055 | 5/1985 | Dove | 162/347 X |
| 4,517,056 | 5/1985 | Roerig et al. | 162/347 X |
| 4,526,654 | 7/1985 | Johansson et al. | 162/347 X |
| 4,539,074 | 9/1985 | Stenberg | 162/347 X |
| 4,545,262 | 10/1985 | Hellwig | 73/862.65 |
| 4,577,513 | 3/1986 | Harwood et al. | 73/862.04 |
| 4,680,089 | 7/1987 | Aral et al. | 162/198 |

OTHER PUBLICATIONS

Karlsson et al., "Optimal Cross-Direction Basis Weight and Moisture Profile Control on Paper Machines", Pulp & Paper Canada, 86:8 (1985), pp. T213-218.

*Primary Examiner*—David A. Simmons
*Assistant Examiner*—Thi Dang
*Attorney, Agent, or Firm*—Spensley Horn Jubas & Lubitz

[57] ABSTRACT

A system and process for controlling the displacement of a thickness regulating member which regulates the basis weight of a sheet being formed from fluid material. The displacement of the thickness regulating member is determined by measuring the forces which slice rods exert on the thickness regulating member.

5 Claims, 3 Drawing Sheets

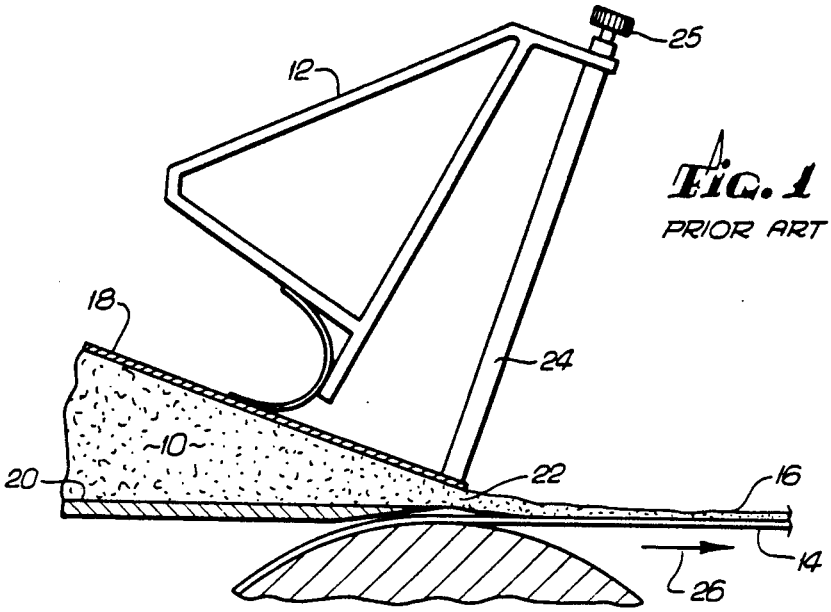
FIG. 1
PRIOR ART
FIG. 8
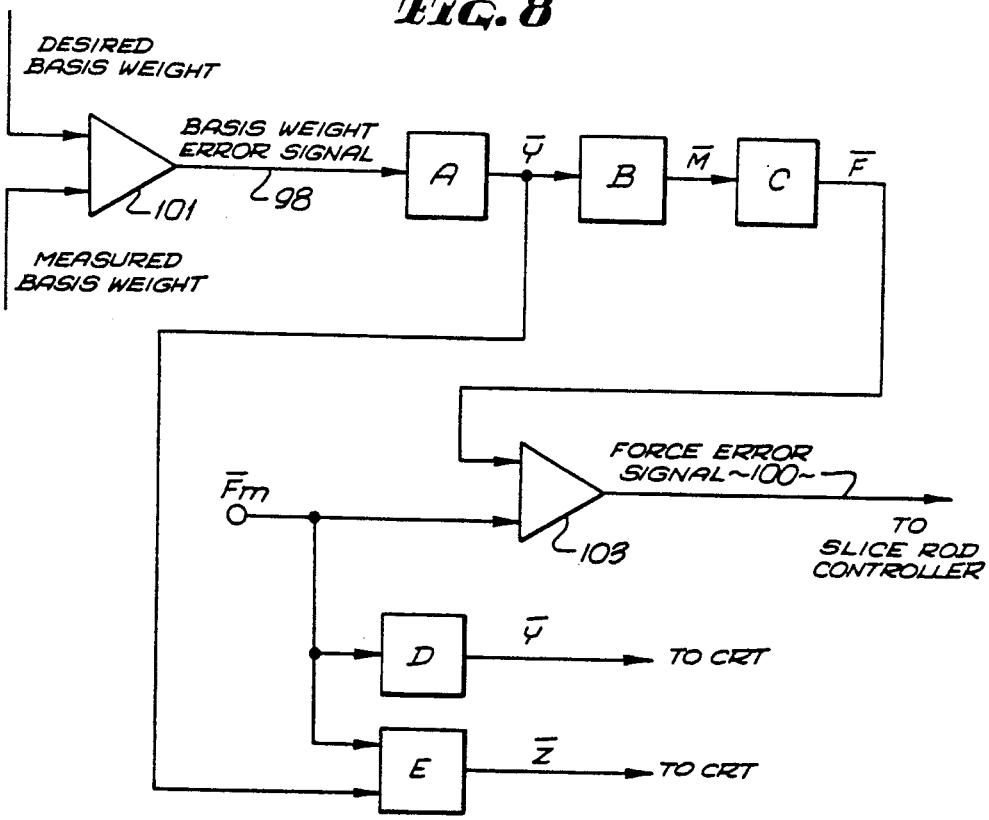

48
60
62
64
66
57
59
72
80
41
40
42
38
36
76
46
44
54
58
56
52
50
10
34
32

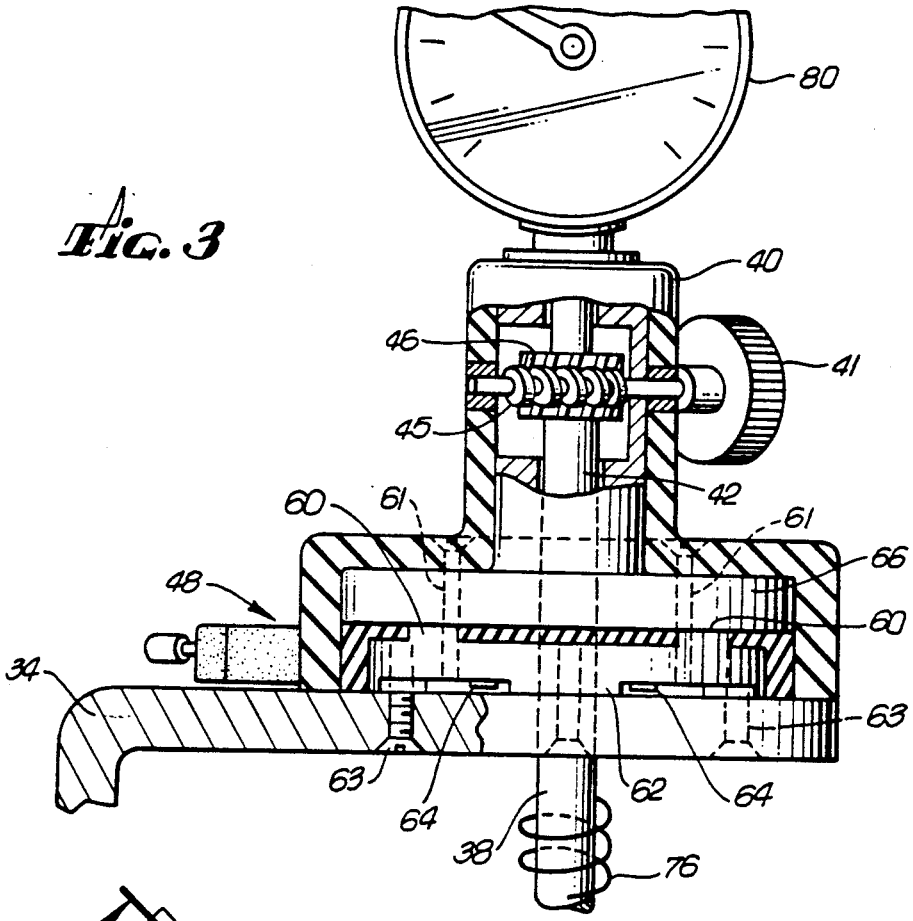
FIG. 3
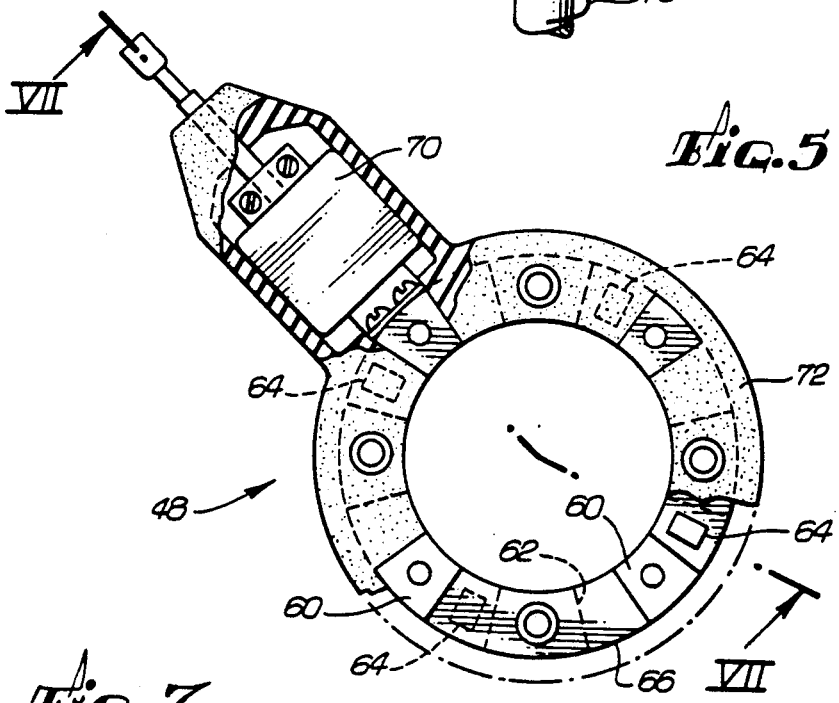
FIG. 5
FIG. 7
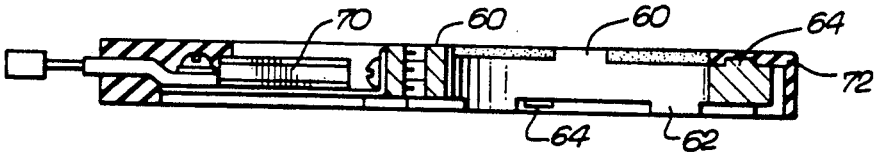

PROCESS AND SYSTEM FOR CONTROLLING THE BASIS WEIGHT OF A SHEET MATERIAL

BACKGROUND OF THE INVENTION

The present invention relates to the manufacture of sheet materials such as paper, and more particularly to the control of the sheet basis weight. Still more particularly, the present invention relates to a system and process for adjusting the slice lip opening of a head box in a paper making machine.

Certain sheet materials are manufactured from starting material which is in a fluid or paste-like state. The manufacturing process for such materials typically involves controlling the flow of the starting material onto a conveyer belt or the like. FIG. 1 is a cross-sectional view of part of an exemplary device used in connection with paper manufacturing. A slurry of paper pulp 10, containing wood pulp fibers in suspension as well as mineral fillers, flows from a head box (only a portion of the headbox is shown as frame 12) onto a moving porous conveyor belt 14 on which the slurry 10 forms a continuous sheet 16 moving in the direction of arrow 26. A thickness-regulating device is used to regulate the flow of the slurry 10 onto the belt 14. The thickness regulating device includes a deformable thickness regulating member called a "slice lip" 18 and a rigid member 20 located at the bottom of the head box frame 12. This rigid member 20 is known as a "forming board". Both the slice lip 18 and forming board 20 span the width of the sheet 16 in the "cross-direction" (i.e. The direction across the width of the sheet perpendicular to the direction of sheet movement). The adjacent edges of the slice lip 18 and forming board 20 are disposed close to one another, thereby defining a space 22 through which the slurry 10 discharges from the head box 12 onto the conveyor belt 14. The slurry 10 dries as it is carried along the belt 14 and thereafter the sheet is typically passed through a system of rollers (not shown) for the removal of additional moisture, and further processing.

The basis weight of the sheet 16 (i.e., the mass of slurry per unit of sheet surface area) is dependent in part on the height of the slice lip opening 22. Typically, the forming board 20 is fixed while the lower edge of the slice lip 18 is movable relative to the forming board 20 to adjust the height of the opening 22. The movement of the slice lip 18 is typically controlled by a number of actuators 24 (only one shown) which are referred to in the paper making art as slice rods. One end of each slice rod 24 is connected to the slice lip 18 near the opening 22 and the other end of each slice rod 24 is connected to the head box frame 12. Typically, a plurality of such slice rods 24 are used. These slice rods 24 are spaced apart from each other at fixed intervals along the length of the slice lip 18 in the cross-direction. The slice lip 18 is deformable under the actions of the slice rods 24 which can be individually adjusted to control the relative displacement of different segments of the slice lip 18, as explained more fully, for example, in commonly assigned U.S. Pat. No. 4,680,089 to Aral et al. The Aral patent is incorporated herein by reference.

In the past, the movements of the slice rods 24 were controlled by manually operated screw jacks 25 which pushed the slice rods 24 against the slice lip 18 (see, for example, FIG. 1). Alternatively, electrical heating coils (not shown in FIG. 1) may be disposed inside the slice rods 24 for changing the temperature of the slice rods 24 and thereby changing the lengths of these rods by thermal expansion and contraction. The length of each slice rod 24 may thus be controlled by controlling the amount of electric current supplied to the corresponding heating coils. The change in rod length changes the height of the opening 22 near the rod 24. Therefore, the heating coils may be individually controlled to displace different segments of the slice lip 18 by different amounts.

The displacement of the slice lip 18, and thus the height of the opening 22, could be determined using a displacement measuring sensor (not shown) coupled to the lower edge of the slice lip 18. For example, the slice lip displacement could be determined by using a linearly variable differential transformer ("LVDT", not shown) coupled between the lower edge of the slice lip 18 and the head box frame 12. LVDTs are well known in the art of measuring displacements. The method of determining the slice lip position using LVDTs is, however, subject to certain limitations and inefficiencies. For example, LVDTs are rather delicate position sensing devices having sliding parts. Because the LVDTs would have to be connected in close proximity to the slurry 10, slurry particles and moisture from the slurry may cover the sliding surfaces, thus causing sticking, jamming and corrosion of the sliding parts.

Another limitation associated with the use of LVDTs to measure slice lip displacements is the high cost involved. It has been found that an accuracy of 0.001 inch is required in many applications, for example, paper making. A relatively expensive, high resolution LVDT is therefore required. The use of LVDTs would be especially costly to a paper manufacturer since the expected LVDT service life is short in the harsh operating environment of a paper mill. The cost further increases when the slice lip displacement is to be determined, as would be required in a paper mill, at a plurality of locations along the the slice lip, thus requiring a plurality of such expensive LVDTs.

SUMMARY OF THE INVENTION

The present invention is directed towards a system and process for measuring and controlling the displacement of a thickness regulating member, such as a slice lip in the head box of a papermaking machine. According to the present invention, the displacement of the thickness regulating member from its nominal position may be determined by measuring the forces which a plurality of slice rods exert against the member and correlating these force measurements with the displacement of the member.

In one illustrative embodiment, the thickness regulating member is the slice lip in a papermaking machine. This slice lip forms one side of an opening in a headbox through which paper slurry is forced under pressure. The slurry is forced through the opening and carried away from the headbox in a manner such that the escaping slurry forms a continuous paper sheet. The amount of slurry escaping from the head box is determined by the size of the opening and hence by the displacement of the slice lip. The displacement of the slice lip is, in turn, controlled by a number of actuators, each comprising a slice rod having one end connected to and exerting a force on the slice lip. Each actuator further includes a force transducer which measures the force of the slice rod on the slice lip. In particular, in accordance with the present invention, the force transducers are preferably coupled to those ends of the slice rods which are not connected to the slice lip. These force transducers thus measure the force exerted by each slice rod on the slice lip, which force is transmitted along the slice rod. The displacement of the slice lip is determined from the measured force. To accomplish this, the slice lip may be displaced by the slice rods and the force at various displacements determined. Thereafter, any force measured by the force transducers can be correlated to a particular slice lip displacement. Alternatively, if the modulus of elasticity of the slice lip, the spring constant of the slice rods, the distance between slice rods and the cross sectional moment of inertia of the slice lip are known, then the displacement of the slice lip for any given force can be computed using well known engineering principles.

In operation, the basis weight of the dryed paper sheet is measured downstream of the slice lip. A conventional basis weight measuring gauge may be used for this purpose. The displacement of the slice lip can then be adjusted using the slice rods to achieve the desired basis weights at various locations across the width of the sheet.

The slice rods are spaced apart from one another defining plural segments of the slice lip, each segment being between two adjacent slice rods. The plurality of slice rods control the shape of the slice lip by controlling the displacement of each segment. The slice rods, in turn, may be controlled by a system control computer which receives the results of the basis weight measurements of the sheet at various downstream locations across the width of the sheet and determines the displacement of each segment of the slice lip required to be made by the slice rods to acheive the desired basis weight profile for the dried paper sheet.

According to the present invention, by measuring the force of the slice rods against the slice lip, the displacement o the slice lip and hence the height of the opening can be determined to a high resolution. One notable advantage of the present invention is that the slice lip can be made relatively stiff so that the change in the force on the slice lip is large for a corresponding small change in slice lip displacement. Thus, when the force measurements are translated to displacement values, a high resolution in the result can be obtained.

Another notable advantage of the present invention is that the force transducers, which measure the force of the slice rods against the slice lip, may be designed to utilize strain gauges and may be positioned on the slice rods at the ends of the slice rods which are opposite the slice lip. In this way, the strain gauges are not subject to contamination by the slurry. Moreover, since there are no moving parts in a strain gauge, even if slurry does splash onto the strain gauges, it could not cause sticking or jamming. The force transducers of the present invention thus provide an accurate and reliable indication of slice lip displacement.

According to the present invention, in a system in which more than one slice rod is used to control the shape of the slice lip opening, the system may be described mathmatically by modeling the slice lip, in the system control computer, as an elastic beam which is loaded at the connecting points of the slice rods to the slice lip. Such a system has been thoroughly analyzed in the mechanical and civil engineering disciplines. Using this mathematical model, the computer determines the force which the slice rods must exert to cause the slice lip to conform to a desired shape. The computer then energizes or deenergizes the electric heating coils (or other devices for forcing the slice rods against the slice lip) so that the slice rods expand and contract against the slice lip until the computed forces at each slice rod are achieved. As previously mentioned, the system incorporates force transducers for measuring the force of the slice rods against the slice lip. Thus, the system computer is able to determine, on a real time basis, when the computed forces are actually being exerted by the slice rods, and control the heating of the slice rods accordingly.

BRIEF DESCRIPTION OF THE DRAWINGS

FIG. 1 is a partial cross-sectional view of a head box and slice lip of a prior art paper making machine.

FIG. 3 illustrates the coupling of a screw jack, a force transducer and a slice rod according to one embodiment of the present invention.

FIG. 5 is a top view of the force transducer of the present invention enclosed in a protective rubber dust shield which is partially broken away in the figure.

FIG. 7 is a cross-sectional view taken along line VII—VII in FIG. 5.

FIG. 8 is a flow chart diagram of the process of the present invention using an elastic beam model to determine the slice rod forces required to obtain the desired slice lip shape.

DETAILED DESCRIPTION OF THE PREFERRED EMBODIMENT

Figures 2, 4, 6:
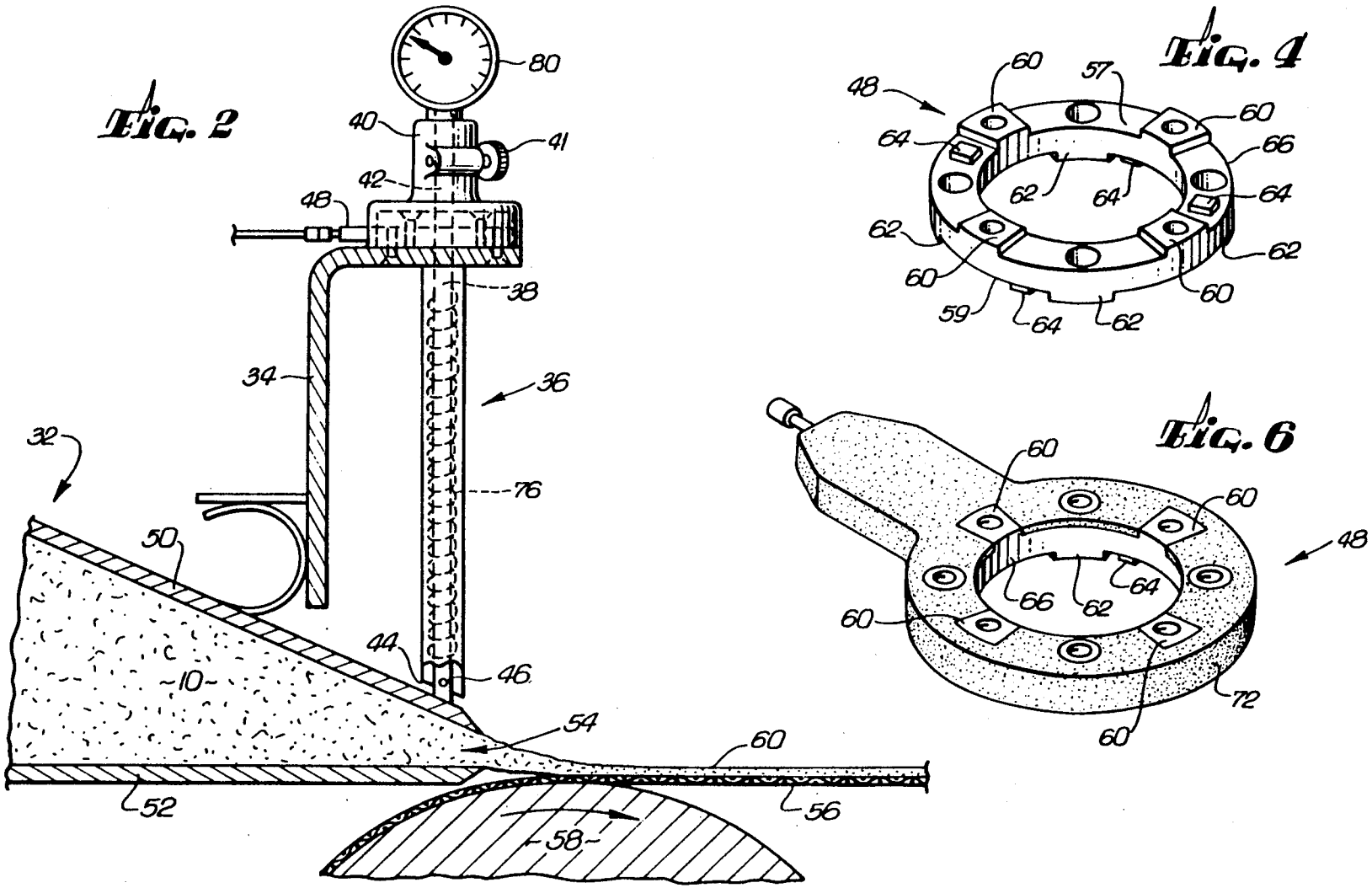
FIG. 2 is a partial cross-sectional view of a head box and slice lip in a paper making machine which incorporates a force transducer according to one embodiment of the present invention.
FIG. 4 illustrates the castellated ring structure of the force transducer according to one embodiment of the present invention.
FIG. 6 is a perspective view of the rubber dust shield substantially enclosing the force transducer.

The following description is of the best presently contemplated mode of carrying out the invention. This description is made for the purpose of illustrating the general principles of the invention and should not be taken in a limiting sense. The scope of the invention is best determined by reference to the appended claims.

FIG. 2 is a partial cross-sectional view of the slice lip region of a head box 32 in a paper making machine. Only part of the head box 32 is shown as frame member 34. Coupled to the frame member 34 is a slice rod assembly 36. The slice rod assembly 36 includes a slice rod 38 which is coupled at its upper end 42 to the frame member 34 by means of a screw jack 40. The slice rod 38 is pivotably coupled at its lower end 44 to a slice lip 50 via a coupling pin 46. As more clearly shown in FIG. 3, the screw jack 40 includes a worm gear wheel 46 and a worm gear shaft 45 operable by a turn knob 41 for moving the slice rod 38 vertically with respect to the frame member 34. The worm gear wheel 46 is threaded onto the upper end 42 of the slice rod 38.

The lower end of the slice lip 50 is movable and opposes a lower, stationary forming board 52. The rotation of the turn knob 41 causes bending of the slice lip 50, thereby effecting displacement of the lower edge of the slice lip 50 with respect to the forming board 52. Paper slurry 10 stored in the head box 32 is forced under pressure through the opening 54 below the slice lip 50 and is deposited as a continuous sheet 60 onto a porous belt 56 which is driven by a breast roll 58 disposed adjacent to the forming board 52. The basis weight of the sheet 60 is therefore dependent, in part, upon the size of the opening 54.

In operation, the nominal height of the opening 54 is manually set using the turn knobs 41. Thereafter, the height of the opening 54 is determined by measuring the force of the slice rods 38 against the slice lip 50, using the force transducers 48. The force of the slice rods 38 against the slice lip 50 varies depending on the displacement of the slice lip 50. Thus, as discussed in detail below, the force measured by the force transducers 48 can be experimentally or theoretically related to the displacement of the slice lip 50.

The details of the force transducer 48 are described with reference to FIGS. 4–7. In the embodiment shown in FIG. 4, the force transducer 48 is annular in shape and has a "castellated" structure. The ring 66 has top and bottom surfaces 57 and 59, respectively, and four upper bosses 60 extending axially from the top surface 57. There are also four lower bosses 62 extending in the opposite direction from the bottom surface 59. The bosses 60 and 62 form the "castles" of the castellated ring structure. The bosses 60 and 62 are equally spaced apart and arranged in an alternating pattern.

Two strain gauges 64 are disposed on the upper surface 57 of the castellated ring 66 and two other strain gauges 64 are disposed on the lower surface of the castellated ring 66. As is well known, the electrical resistance of a strain gauge varies as it is deformed under a force. Furthermore, the change in resistance of the strain gauges 64 is proportional to the deforming force. The strain gauges 64 are used to measure the axial forces which cause deformation of the the ring 66 and which arise from relative axial movement of the bosses 60 and 62. Specifically, each strain gauge 64 is rigidly attached to the ring 66 at a location on the upper or lower surfaces, 57 and 59, between an upper boss 60 and a lower boss 62, as shown in FIG. 4. When the ring 66 is deformed axially, the strain gauges 64, which are rigidly attached to the ring, 66 are also deformed. By wiring the 4 strain gauges 64 in a conventional "Wheatstone" bridge circuit commonly used in connection with strain gauges, the output of the Wheatstone bridge circuit will be representative of the axial forces on the ring 66.

Referring to FIG. 3, the castellated ring 66 is mounted between the base of the screw jack 40 and the top of the frame member 34. The upper bosses 60 are fastened to the base of the screw jack 40 using screws 61. The lower bosses 62 are similarly screwed to the frame member 34 with screws 63. It can be seen from FIGS. 2 and 3 that the upward force of the slice lip 50 on the slice rod 38 pushes the screw jack 40 away from the frame member 34, thus deforming the castellated ring 66. As a result, the strain gauges 64 are deformed and the outputs of the strain gauges 64 represent the axial force which the slice rod 38 exerts on the ring 66. This force is indicative of the vertical movement the slice rod 38 and hence the deflecttion of the slice lip 50 at the point where the slice lip 50 is connected to the slice rod 38.

The typical force exerted by the slice rod 38 on the slice lip 50 is on the order of 500 Kg. The corresponding movement of the slice lip 50 is on the order of 1/1000 inch. Thus, by measuring the force exerted on the castellated ring 66, small displacements can be detected without requiring expensive devices such as the high precision LVDTs previously described. It is also important to note that, because the force transducer 48 is annular, and is disposed symmetrically around the slice rod 38, the force transducer 48 can easily be made sufficiently strong to support the large deflecting forces. Moreover, the axial deformation of the ring structure 66 does not impart any horizontal movement to the slice rod 38.

The electronic amplifiers and associated circuitry which produce a useful signal from the strain gauges may be formed on a printed circuit board 70 and attached to the castellated ring 66, as shown in FIG. 5. The ring 66, strain gauges 64 and the circuit board 70 may then be enclosed in a protective rubber dust shield 72 to prevent corrosion of the force transducer 48 when, for example, it is put into operation in the hot and humid environment of a paper making machine.

The output signal from the printed circuit board 70 may be applied as feedback to the system control computer (not shown) which controls the height of the slice lip opening 54 at each segment of the slice lip 50. The system computer may be utilized to process the information received from the force transducers 48 and to transmit control signals to a slice rod controller (not shown) to adjust the height of the opening 54 at each slice rod position. As previously mentioned, one type of slice rod controller utilizes heating coils 76 which wrap around the slice rod 38. The heating coils 76 extend substantially the full length of each slice rod 38. The heating coils 76 are coupled to an electric current supply (not shown). The supply of current to the heating coils is controlled by the computer. When electric current is applied to the heating coils 76 wrapped around a particular slice rod 38, the heating coils 76 warm up, thus heating the slice rod 38 so that the rod 38 expands and becomes longer. This forces the slice lip 50 downward at the point where the slice rod 38 is connected to the slice lip 50, thereby reducing the height of the opening 54 in the vicinity of the slice rod 38. When the current is reduced, the heating coil 76 cools and the slice rod 38 contracts, thus lifting the slice lip 50 and thereby increasing the height of the opening 54 in the vicinity of the slice rod 38. It will be appreciated that by controlling the amount of electric current supplied to the heating coils 76, the height of the slice lip opening 54 can be adjusted to a desired size. Furthermore, by monitoring the output from the force transducers 48, the computer can determine the position of the slice lip 50 at each slice rod 38.

When the above-described slice rod control is put into operation, the following start-up procedure may be followed. A predeterminded amount of electric current is applied to the heating coils 76 around each slice rod 38 to heat the slice rods 38 above ambient temperature. The turn knobs 41 of the screw jacks 40 are then manipulated to obtain roughly the desired nominal height of the opening 54 along the entire length of the slice lip 50. A rough reading of the height of the opening can be obtained by coupling a dial indicator 80 (see FIGS. 2–3) to the screw jacks 40 to provide an indication of the displacement of the ends 44 of each of the slice rods 38. However, since the adjustment of the turn knob 41 associated with any slice rod 38 affects the slice lip position at adjacent slice rods 38, it is difficult to obtain a perfectly flat slice lip 50. Also, the slurry is usually pumped into the headbox at elevated temperatures so that the slurry will heat up the slice rods 38 during operation, and thereby change the height of the opening.

After a rough adjustment of the slice lip 50 is performed using the turn knobs 41, the exact starting profile of the slice lip 50, and all subsequent profiles, may thereafter be determined by the force transducers 48. The system control computer then reduces or increases the heating of the slice rods 38 to fine adjust the width of the opening 54. For example, to achieve a perfectly flat opening, the computer increases or decreases the heating of the slice rods 38 until no force is measured by any of the force transducers 48. Thus, by coupling the force information provided by the force transducers 48 to the system control computer, the slice lip profile can be adjusted to maintain a desired profile.

The control of the profile of the opening 54 can be facilitated by first establishing the slice lip shape which will give the desired basis weight profile, and then determining the required slice lip movements that will result in the desired slice lip shape. In certain applications, it may be desireable to have a flat slice lip profile across the width of the sheet. However, in papermaking, for example, drainage may not be uniform across the entire width of the sheet so that some portions of the sheet may have a greater than average basis weight, even though the slice lip is perfectly flat. In this situation, the slice lip profile can be adjusted to compensate for the effects on basis weight of non-uniform drainage, and thereby achieve a uniform sheet basis weight.

It has been found that the required slice rod movement can be determined based upon consideration of the physical characteristics of the slice lip. For example, in the previously mentioned Aral et al. patent, the slice lip 50 is modeled as an elastic beam which is supported by elastic supports and loaded at the slice rods 38. The elastic beam model is well analyzed in mechanical and civil engineering disciplines, and various approximations are made in the particular embodiment described herein to simplify the calculations. An approxamation suitable for slice lip control is achieved by considering the slice lip 50 as a slender elastic beam, and its displacements small with respect to its other dimensions. The slice lip 50 is loaded by the slice rod forces at the slice rod locations which are spaced equally along the length of the slice lip 50. The slice rod forces which are measured by the castellated force sensors of the present invention arise due to the loading of the slice rods 38 against the slice lip 50, thereby causing the ring 66 associated with each transducer 48 to deform. As previously mentioned, the deformation of the ring 66 is correlated with the forces applied by the slice rods 38 and measured by the strain gauges 64.

Two adjacent slice rods 38 define in between them a slice lip segment. The forces exerted by the slice rods 38 at the ends of each segment cause displacements of the slice lip 50 so as to result in a bending moment in the slice lip 50 at the lower end of each slice rod 38. Assuming each slice rod 38 applies only a point force to the slice lip 50, the moment of each segment is directly related to the radius of curvature of the segment bent under the slice rod forces. The relationship between the bending moment and the displacement of the slice lip 50 at each slice rod 38, the slice rod forces and the slice rod movements are given below by the following equations (expressed in matrix form):

$$[P]\,\overline{M} = c\,[R]\,\overline{Y} \quad (1)$$

$$[D]\,\overline{M} = \overline{F} \quad (2)$$

$$\overline{F} = k(\overline{Z} - \overline{Y}) \quad (3)$$

where $\overline{Z}$ = a vector representing the elongation of each slice rod 38;

$\overline{F}$ = a vector representing the force of each slice rod 38 acting on the slice lip 50;

$\overline{Y}$ = a vector representing the displacement of the slice lip 50 at each slice rod 38;

$\overline{M}$ = a vector representing the bending moments of the slice lip 50 at each slice rod 38;

k = the spring constant of the slice rods 38;

c = a constant which is dependent on the modulus of elasticity of the slice lip 50, the cross-sectional moment of inertia of the slice lip 50, the distance between slice rods 38 and k;

$$[P] = \begin{bmatrix} 1 & 0 & 0 & . & . & . & . & 0 \\ 1 & 4 & 1 & 0 & . & . & . & 0 \\ . & . & . & . & . & . & . & . \\ 0 & 0 & . & . & . & 1 & 4 & 1 \\ 0 & 0 & . & . & . & . & 0 & 0 \end{bmatrix};$$

$$[D] = \begin{bmatrix} 0 & 1 & 2 & 3 & . & . & . & (n-1) \\ 0 & 0 & 1 & 2 & 3 & . & . & (n-2) \\ . & . & . & . & . & . & . & . \\ . & . & . & . & . & . & . & . \\ 0 & 0 & . & . & . & . & . & 1 \\ 1 & 1 & . & . & . & . & . & 1 \end{bmatrix}$$

(where $n$ = number of slice rods); and $$[R] = \begin{bmatrix} 0 & . & . & . & . & . & . & 0 \\ 1 & -2 & 1 & 0 & . & . & . & 0 \\ 0 & 1 & -2 & 1 & 0 & . & . & 0 \\ . & . & . & . & . & . & . & . \\ . & . & . & . & . & . & . & . \\ 0 & . & . & . & 0 & 1 & -2 & 1 \\ 0 & . & . & . & . & . & . & 0 \end{bmatrix}$$

Matrices [P], [D] and [R] are derived from the elastic beam model as discussed in the Aral et al. patent, and based on the assumptions previously mentioned. As also discussed in the Aral et al. patent, $$C = \frac{6EI}{k13},$$

where E is the modulus of elasticity of the slide lip, I is the cross-sectional moment of inertia of the slice lip and 1 is the distance between slice rods. In the event that any or all of the above assumptions are not satisfied, different matrices could be computed based upon the elastic beam model. However, it has been found that the above matrices are applicable to most practical cases involving slice lips.

The equations (1) to (3) may be combined into the following equation which describes the slice lip displacements from a flat configuration as a function of slice rod elongations:

$$[A]\,\overline{Z} = \{c\,[R] + [A]\}\,\overline{Y} \quad (4)$$

where $[A] = [P][D]$

In situations where it is not convenient to determine the parameters E and I, equation (4) may be used to experimentally determine the constant "c" since matrixes [R] and [A] are known, and $\overline{Y}$ and $\overline{Z}$ may be measured.

FIG. 8 describes, in flow chart form, the application of the slice lip model to determine the required slice rod forces necessary to obtain the desired slice lip shape. The basis weight of the sheet 60 is measured at various locations across the width of the sheet at a suitable location downstream of the slice lip 50. These measurements are then input into a comparator 101 and compared to the desired basis weight. If the measured basis weight is different from the desired basis weight at any location, an error signal 98 is issued from the comparator 101.

Routine A is then triggered to calculate the desired slice lip displacements $\overline{Y}$ which will give the desired basis weight of the dry sheet. One way to obtain the desired slice lip displacements $\overline{Y}$ is to first determine the additional or excess area of the slice lip opening which must be added or subtracted to achieve the desired basis weight (the correspondance between basis weight of the dry sheet and the area of the slice lip opening can be determined by prior experiment). The change in $\overline{Y}$ which will produce the additional area below each slice lip segment or remove the excess area may then be determined by geometrical calculation. It has been found, for example, that an acceptable result is obtained by approximating the area under the slice lip 50 and between adjacent slice rods 38 as a triangle.

Based upon the computed slice lip displacements $\overline{Y}$ routine B then calculates, using equation (1), the bending moments $\overline{M}$ of the segments at each slice rod 38. Using the computed moments $\overline{M}$, routine C determines, using equation (2), the slice rod forces $\overline{F}$ corresponding to the computed slice lip moments $\overline{M}$ at each slice rod 38.

The slice rod forces $\overline{F}$, computed above using the slice lip model, are compared by comparator 103 to the slice rod forces, $\overline{F}_m$, measured using the force transducers 48 discussed previously. If there is any difference between the computed and measured values, $\overline{F}$ and $\overline{F}_m$, an error signal 100 is issued. This error signal, 100, causes a slice rod controller (not shown) to effect a change in slice rod position. In the particular slice rod assembly 36 previously discussed, slice rod extension is brought about by thermal expansion and contraction of the slice rods effected by the heating coils 76. The error signal 100 is therefore used by the system control computer to control the current supplied to the heating coils 76 to obtain the desired force at each slice rod 38.

By using the previously described elastic bending model of the slice lip 50, physical constraints of the system can be easily incorporated into the control system. Such constraints may, for example, be limitations in slice lip displacements and/or bending moments, and slice rod movements (slice rod movements, $\overline{Z}$, may be determined from equation (3)). Often, such constraints are necessary to prevent operation of the system beyond its physical limits. For example, the elastic bending limit of the slice lip 50 can be incorporated into the control loop and used to prevent plastic deformation of the slice lip 50. For this situation, the maximum slice lip bending moment or the maximum slice rod forces that the slice lip can sustain is input to the system control computer as a constraint parameter at routine B or C, respectively, and the heating and cooling of the slice rods 38 are limited so that the forces on the slice lip 50 do not exceed these constraints. Slice lip bending limits may also be incorporated into the control loop to prevent the slice lip 50 from attaining too sharp a curvature. Excessive curvature of the slice lip 50 can cause turbulent flow of the slurry as it exits the headbox 34, thereby creating nonuniformities in the basis weight of the resulting sheet.

Moreover, based upon the measured forces, $\overline{F}_m$, at each slice rod 38, the actual slice lip profile can be computed by routine D using equations (1) and (2) where $\overline{F}_m$ is substituted for $\overline{F}$. The computed slice lip profile can then be graphically displayed to the operator, for example, on a cathode ray tube. Also, using equations (1). (2), and (3), and the measured force, $\overline{F}_m$, in routine E of FIG. 8, the extension of each slice rod 38, $\overline{Z}$, may be computed and displayed.

Since the extension of each slice rod 38 can be computed and displayed based upon actual force measurements at each slice rod 38, the operator will be able to determine whether a slice rod actuator has failed to operate properly. For example, the operator may increase or decrease the current supplied to a particular slice rod 38 while directing the computer to display the value of $\overline{Z}$ for the particular slice rod 38. If the measured force on the slice rod 38, and/or the computed and displayed $\overline{Z}$ value does not change by a predetermined amount, then the operator will know that the particular slice rod 38 is malfunctioning and should be repaired or replaced.

In summary, the present invention provides a means for determining the displacement of a thickness regulating member, such as a slice lip, by measuring the force acting on the slice rods which control the displacement of the member. The force measurements are typically large as compared to the corresponding displacement, and thus the resolution of the displacement measurement and control of the thickness member can be extremely precise.

One preferred embodiment of the present invention has been described. Nevertheless, it will be understood that various modifications may be made without departing from the spirit and scope of the invention. For example, although the present invention has been described specifically with reference to paper making, the invention is also suitable for processing other sheet materials, such as plastic. The invention may also employ actuators of a type other than thermally controlled slice rods. Accordingly, it is to be understood that the invention is not to be limited by the specific illustrated embodiment, but only by the scope of the appended claims.

We claim:

1. A process for controlling the shape of a slice lip of a paper making machine headbox used in the production of a paper sheet, comprising the steps of:

measuring the force of a plurality of slice rods against the slice lip at a plurality of locations along the span of the slice lip across the sheet;

computing the forces of the slice rods against the slice lip at each location which are required to achieve a desired sheet basis weight profile;

adjusting the forces of the slice rods against the slice lip so that the measured forces substantially equal the computer forces.

2. The process of claim 1, wherein the forces are measured using force transducers coupled to the slice rods.

3. A system for controlling the shape of a slice lip of a papermaking machine headbox, comprising:

(i) a stationary support;

(ii) a slide lip;

(iii) a plurality of slice rod assemblies, each assembly including:

(a) at least one slide rod coupled between the stationary support and the slide lip;

(b) a force transducer coupled to the slide rod for measuring the force of the slide rod exerted against the slice lip;

(iv) means responsive to the force measurement from said force transducer for determining the position of the slide lip with reference to the support; and (v) control means for moving at least one end of the respective slice rods to obtain a desired slice lip shape based upon the determined slice lip positions.

4. A system as in claim 3, wherein the control means includes:

means for determining the desired slice lip shape;

means for determining the deforming forces which must be applied to the slice lip to achieve the slice lip movements required to substantially obtain the desired slice lip shape; and means for controlling the deforming forces to achieve the desired slice lip shape.

5. The system of claim 4, wherein the means for determining the deforming forces includes a computer, and where the computer is programmed to use the following equations to determine the deforming forces:

$$[P]\,\overline{M} = c\,[R]\,\overline{Y} \quad (1)$$

$$[D]\,\overline{M} = \overline{F} \quad (2)$$

where $\overline{F}$=a vector representing the force of each slice rod acting on the slice lip;

$\overline{Y}$=a vector representing the displacement of the slice lip at each slice rod;

$\overline{M}$=a vector representing the bending moments of each slice lip segment;

c=a constant which is dependent on the modulus of elasticity of the slice lip, the cross-sectional moment of inertia of the slice lip, the distance between slice rods and the spring constant of the slice rods;

$$[P] = \begin{bmatrix} 1 & 0 & 0 & . & . & . & . & 0 \\ 1 & 4 & 1 & 0 & . & . & . & 0 \\ . & . & . & . & . & . & . & . \\ 0 & 0 & . & . & . & 1 & 4 & 1 \\ 0 & 0 & . & . & . & . & 0 & 0 \end{bmatrix}$$

$$[D] = \begin{bmatrix} 0 & 1 & 2 & 3 & . & . & . & (n-1) \\ 0 & 0 & 1 & 2 & 3 & . & . & (n-2) \\ . & . & . & . & . & . & . & . \\ . & . & . & . & . & . & . & . \\ 0 & 0 & . & . & . & . & . & 1 \\ 1 & 1 & . & . & . & . & . & 1 \end{bmatrix}$$

($n$ = number of slice rods); and $$[D] = \begin{bmatrix} 0 & . & & . & . & . & . & 0 \\ 1 & -2 & 1 & 0 & . & . & . & 0 \\ 0 & 1 & -2 & 1 & 0 & . & . & 0 \\ . & . & . & . & . & . & . & . \\ . & . & . & . & . & . & . & . \\ 0 & . & . & . & 0 & 1 & -2 & 1 \\ 0 & . & . & . & . & . & . & 0 \end{bmatrix}$$

* * * * *